US012760728B2

(12) United States Patent
Nowell et al.

(10) Patent No.: US 12,760,728 B2
(45) **Date of Patent: *Oct. 13, 2026**

(54) FLUID END PLUG WITH BORE CLEARANCE

(71) Applicant: Kerr Machine Co., Sulphur, OK (US)

(72) Inventors: Mark S. Nowell, Ardmore, OK (US); Kelcy Jake Foster, Sulphur, OK (US); Christopher Todd Barnett, Stratford, OK (US)

(73) Assignee: Kerr Machine Co., Sulphur, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/262,339

(22) Filed: Jul. 8, 2025

(65) Prior Publication Data

US 2025/0334119 A1 Oct. 30, 2025

Related U.S. Application Data

(60) Continuation of application No. 17/865,488, filed on Jul. 15, 2022, now Pat. No. 12,378,957, which is a division of application No. 16/422,446, filed on May 24, 2019, now abandoned.

(60) Provisional application No. 62/676,656, filed on May 25, 2018.

(51) Int. Cl.

| | |
|---|---|
| ***F04B 53/22*** | (2006.01) |
| ***F04B 47/00*** | (2006.01) |
| ***F04B 53/16*** | (2006.01) |
| *E21B 43/26* | (2006.01) |
| *F04B 15/02* | (2006.01) |

(52) U.S. Cl.

CPC ..... *F04B 53/22* (2013.01); *F04B 47/00* (2013.01); *F04B 53/16* (2013.01); *E21B 43/2607* (2020.05); *F04B 15/02* (2013.01)

(58) Field of Classification Search

CPC ..... F04B 1/04; F04B 1/0404; F04B 1/0448; F04B 15/00; F04B 15/02; F04B 47/00; F04B 53/16; F04B 53/162; F04B 53/22; E21B 43/26; E21B 43/2607; F16L 37/02; F16L 37/28; F16L 37/60; F16L 55/10; F16L 55/11; F16L 55/115; F16L 57/005

USPC ..... 138/89

See application file for complete search history.

(56) References Cited

U.S. PATENT DOCUMENTS 3,185,103 A * 5/1965 Reinhard ..... F04B 15/00 417/454
4,705,459 A * 11/1987 Buisine ..... F04B 51/00 417/63
5,362,215 A * 11/1994 King ..... F04B 49/10 137/542

(Continued)

FOREIGN PATENT DOCUMENTS

WO WO-2016003686 A1 * 1/2016 ..... F16L 55/11

*Primary Examiner* — Bryan M Lettman
*Assistant Examiner* — Chirag Jariwala
(74) *Attorney, Agent, or Firm* — Tomlinson McKinstry, P.C.

(57) ABSTRACT

A closure for a fluid end having a middle sealing section which engages a seal. The sealing section either has a larger outer diameter than adjacent sections or contacts a bore with a smaller inner diameter than adjacent sections. In either case, the clearance formed on either side of the sealing section reduces friction and allows the closure to be rocked back and forth to insert and remove the closure from the fluid end bore.

14 Claims, 6 Drawing Sheets

(56) References Cited

U.S. PATENT DOCUMENTS

| | | | | |
|---|---|---|---|---|
| 2010/0038070 | A1* | 2/2010 | Blanco et al. | F04B 53/22 166/250.03 |
| 2017/0089473 | A1* | 3/2017 | Nowell et al. | F16K 5/0471 |
| 2017/0204850 | A1* | 7/2017 | Graham et al. | F04B 49/24 |

* cited by examiner

FLUID END PLUG WITH BORE CLEARANCE

SUMMARY

The present invention is directed to a fluid end. The fluid end comprises a housing, a bore, and a plug. The housing has an external surface and an internal chamber. The bore is formed in the housing and joins the internal chamber to the external surface. The plug is installed within the bore adjacent to the external surface. The plug and the bore cooperate to define a longitudinally-extending closure zone. The closure zone comprises a first region and a second region. The first region is spaced from the external surface and the plug engages the walls of the bore in that region. The plug does not engage the walls of the bore in the second region. The second region adjoins the first region and extends without interruption to the external surface.

DETAILED DESCRIPTION

This invention relates generally to high-pressure fracturing pumps used for oil bearing formation stimulation, also known as fracking. The most common design of such a pump includes two sub-assemblies, the power end and the fluid end. More specifically, this invention provides improvements to the discharge and suction plugs commonly used in the fluid end portion of these pumps.

A typical fluid end has four ports in each section and multiple sections. One port is the inlet port and is connected to the fluid source. A second port allows the plunger access to the pressure chamber. The third and fourth ports, commonly called the discharge and suction ports, allow access to the inside of the fluid end for assembly and maintenance and are sealed by plugs when the fluid end is in operation. One exemplar fluid end is provided in U.S. Pat. Pub. No. 2019/0017503, the contents of which are incorporated by reference herein.

Figure 3:
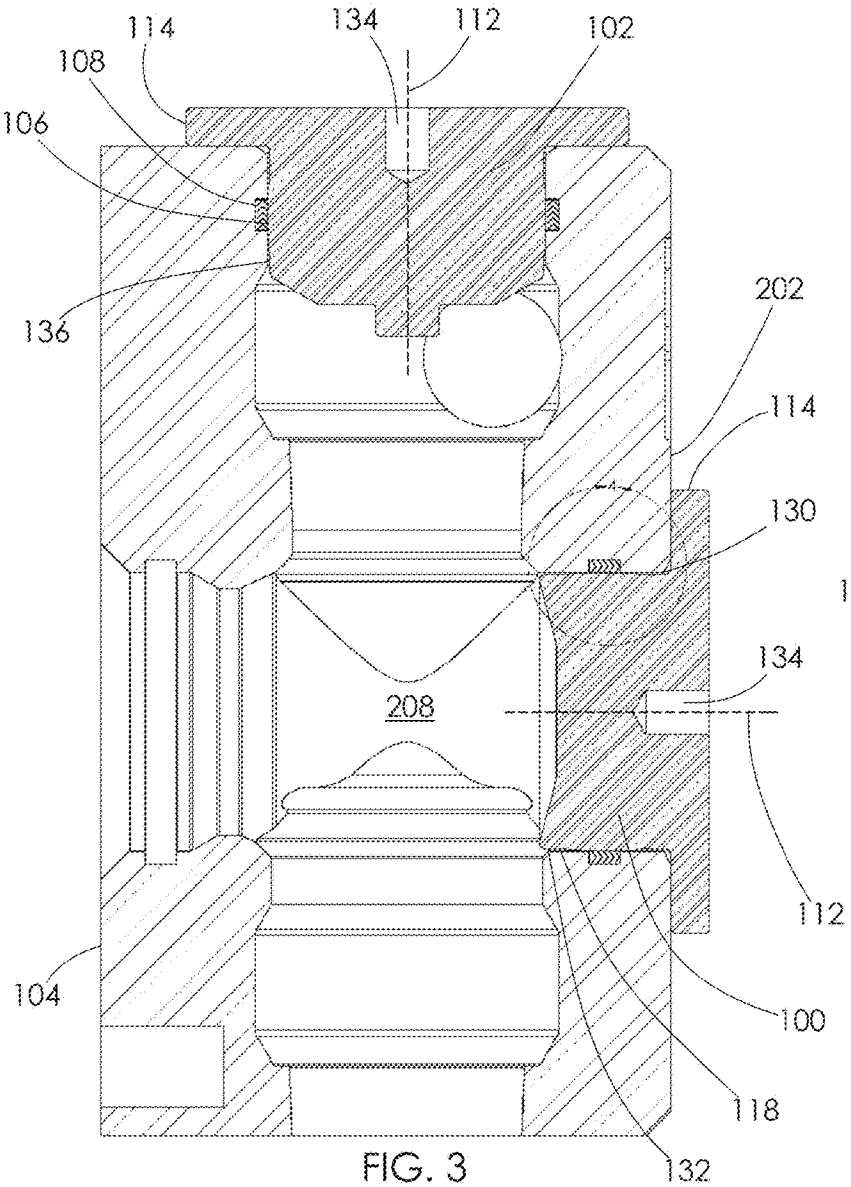
FIG. 3 is a sectional view of a fluid end having the suction plug of FIG. 1 and the discharge plug of FIG. 2 installed within. Hardware, such as valves, seats, springs, the plunger and stuffing box sleeves, has been removed from this figure for clarity.
Figure 5:
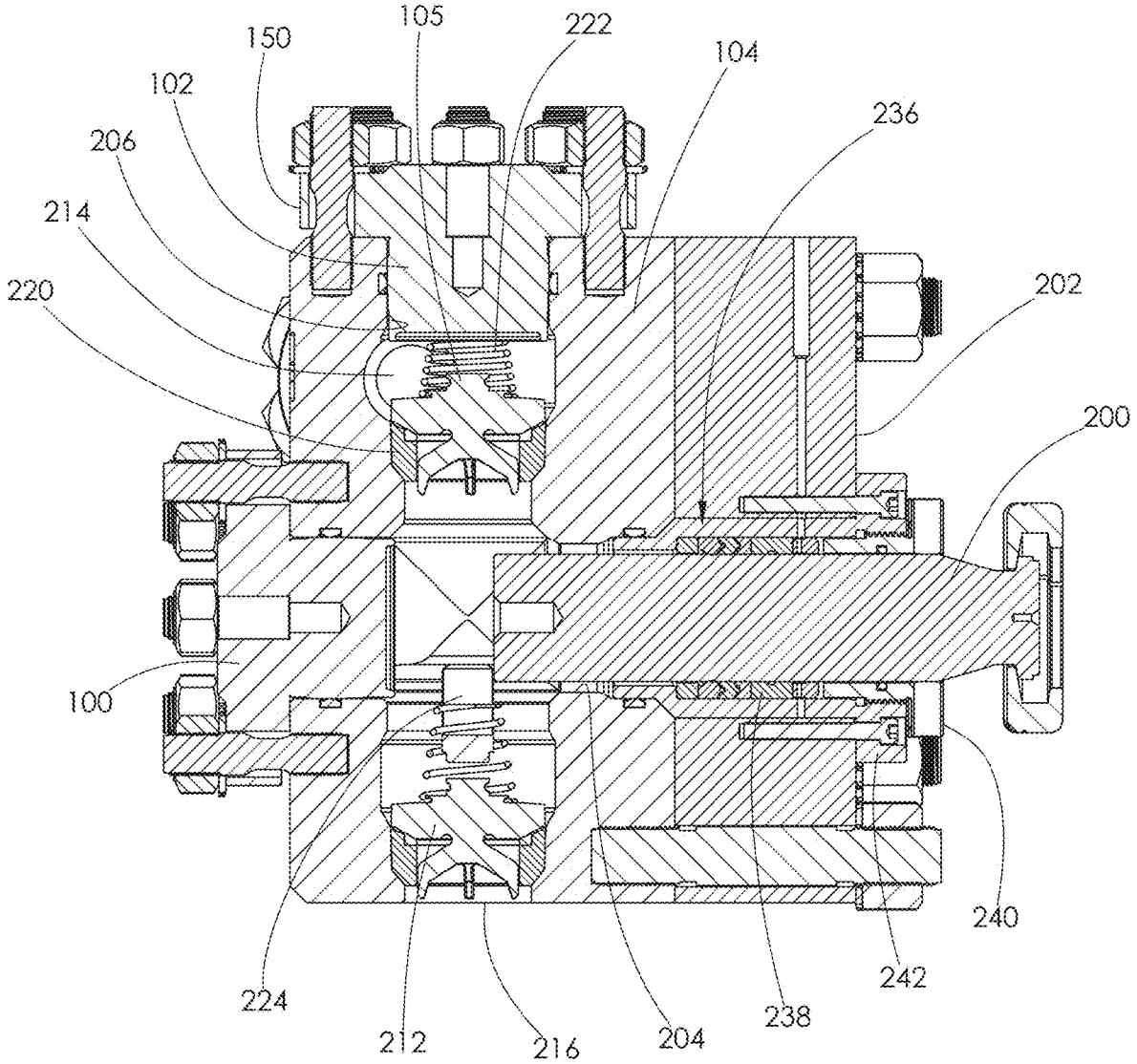
FIG. 5 is a sectional view of a fluid end having a plug and retainer with a unitary construction. Hardware removed from FIG. 3 is included in FIG. 5.
Figure 6:
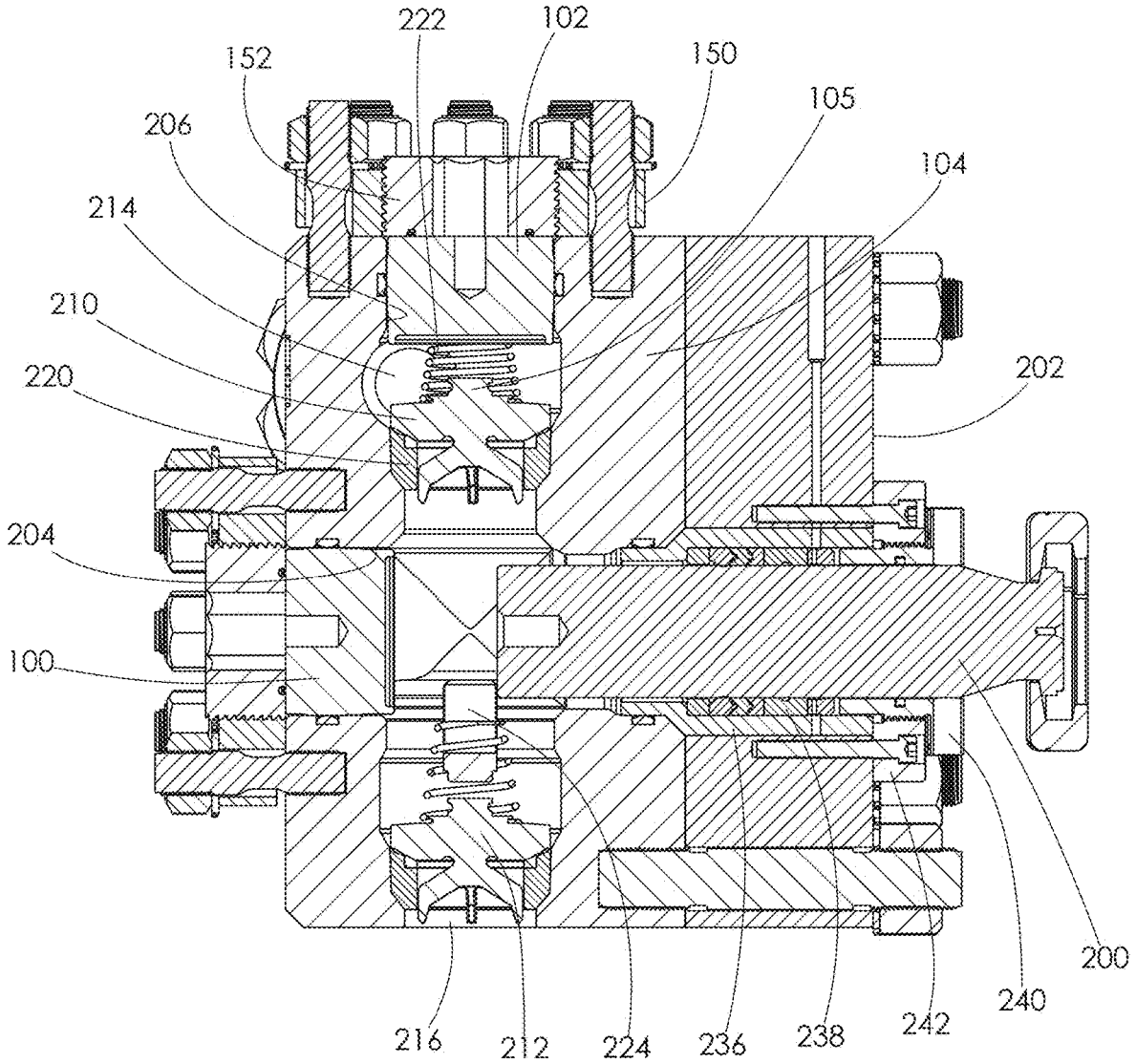
FIG. 6 is a sectional view of a fluid end having a divided plug and retainer construction. Hardware removed from FIG. 3 is included in FIG. 6.

A fluid end, such as fluid end body 104 shown in FIGS. 3, 5 and 6, is a conduit for fluid in which low-pressure fluid enters the fluid end and is discharged at a high pressure due to operation of a reciprocating plunger 200.

FIGS. 5 and 6 show individual components of an exemplar fluid end. The fluid end 104 has an external surface 202. A first bore 204 and a second bore 206 are formed in the fluid end body 104 and interconnect the external surface 202 with an internal chamber 208. The internal chamber 208 is the location where the bores 204, 206 meet. The fluid end 104 may be constructed of two or more sections as shown in FIGS. 5 and 6. Typically, three or five sections are utilized, with plungers 200 reciprocating out-of-phase to approximate constant flow on the high pressure side of the fluid end 104.

A pair of valves 210 and 212 are positioned within each second bore 206. The valves 210, 212 route fluid flow within the body 104. The discharge valve 210 regulates fluid flow through a discharge opening 214. The intake valve 212 regulates fluid flow through one or more intake openings 216 and prevents backflow therethrough. A plurality of couplers may be attached to each discharge opening 214 for connection to a piping system (not shown).

A suction plug 100 is utilized within the first bore 204 to close the first bore and allow access within the fluid end 104 to repair and replace components related to the intake valve 212. A discharge plug 102 is utilized within the second bore 206 to close the second bore and allow access within the fluid end to repair and replace components related to the discharge valve 210.

Each plug 100, 102 is held in place by a retainer 150. As shown in FIG. 5, the retainer 150 may be unitary with the plug, while in FIG. 6, the retainer 150 is a separate piece, and includes an internally threaded nut 152 that holds the plug in the bore. The retainer 150 is secured to the external surface 202 with bolts, screws, or other fasteners.

Each valve 210, 212 may utilize a valve seat 220 and a spring 222. The valve seat 220 provides a surface for sealing the valve. The spring 222 provides biasing force to properly open and close the valves. As shown, the spring 222 disposed on the discharge valve 210 is seated against the discharge plug 102. The spring 222 may be seated against other components as well, such as a valve retainer 224.

The plunger 200 is within the first bore 204 and is reciprocated by a power end (not shown) to drive fluid into the internal chamber 208 from the intake opening 216 and out the discharge opening 214 at a high pressure. The first bore 204 includes a stuffing box sleeve 236. The sleeve 236 surrounds the plunger 200 and associated packing 238 which enables the plunger 200 to repeatedly extend and retract within the fluid end 104. A packing nut 240 may be used to hold packing 238 in place. As shown, a plunger bore retainer 242 is bolted to the external surface 202 of the fluid end 104. The retainer 242 engages the stuffing box sleeve 236.

Due to the large operating pressures of the fluid end, up to 20,000 psi, the discharge and suction plugs require their sealing surfaces, or those of the fluid end body, to be manufactured to small clearances between the sealing surface and seals for proper sealing and operating life. These small clearances have typically been applied to the entire length of the plug as installed in each respective port even though only a relatively short axial length is engaged with the seal. The small clearances cause the assembly and disassembly of the plugs to the fluid end to be much more difficult.

If the plug is threaded the torque required to assemble or disassemble is increased greatly due to friction between the outside diameter of the plug and inside diameter of the port. If the plug is not threaded the assembly force is also increased because of the friction between the parts. Typically, large wrenches and/or impact wrenches are used to assemble and disassemble threaded plugs and slide hammers are used to assemble and disassemble non-threaded plugs. A reduction in the assembly and disassembly effort is needed.

The invention described in the listed embodiments reduces the effort required to install or remove discharge and suction plugs from fluid end bodies. Specifically, the invention eliminates the small clearances, except where absolutely necessary, between the outside diameter of the plug and the inside diameter of the bore the plug is installed in during operation.

Figure 1:
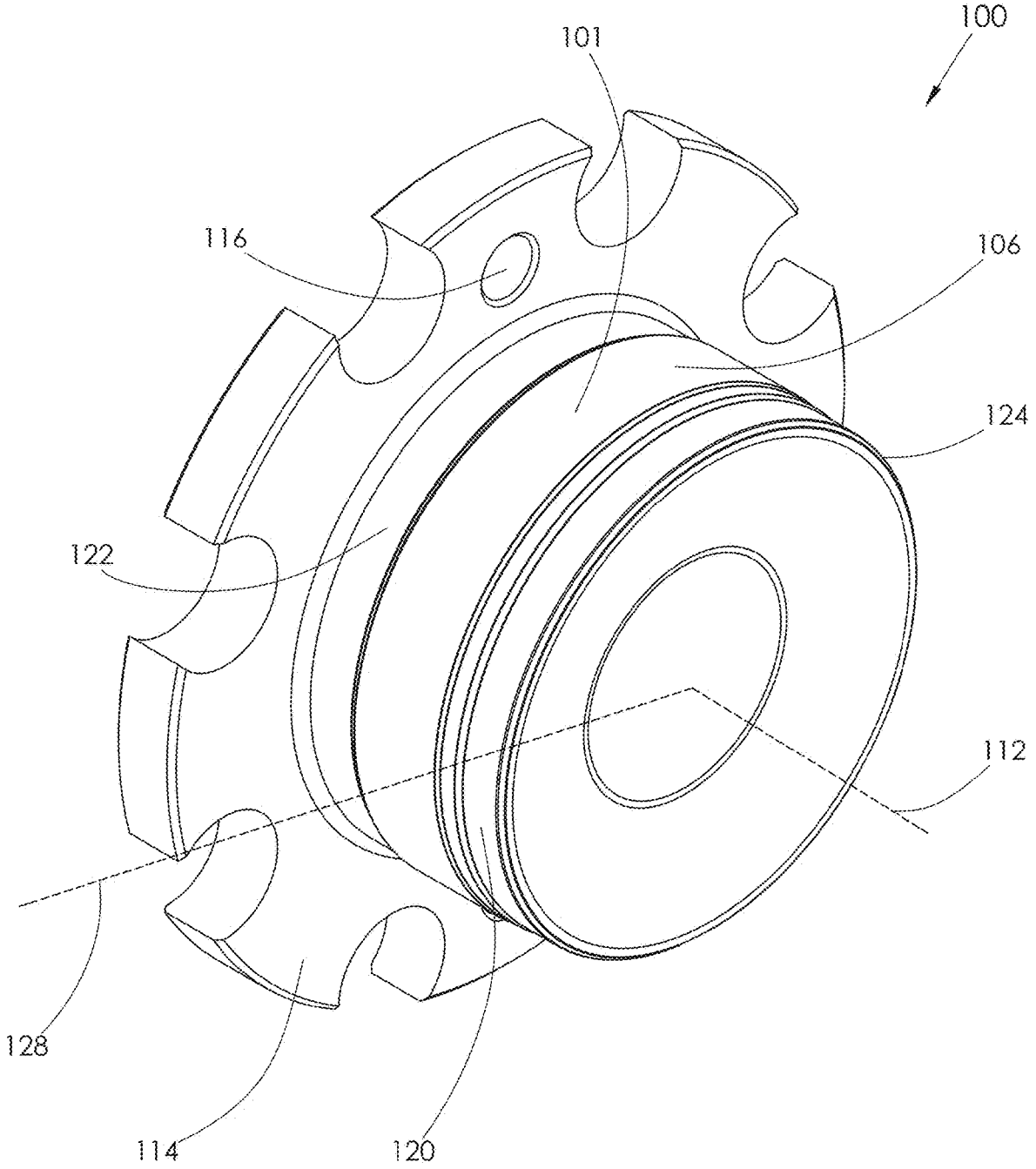
FIG. 1 is an isometric view of a suction plug.
Figure 2:
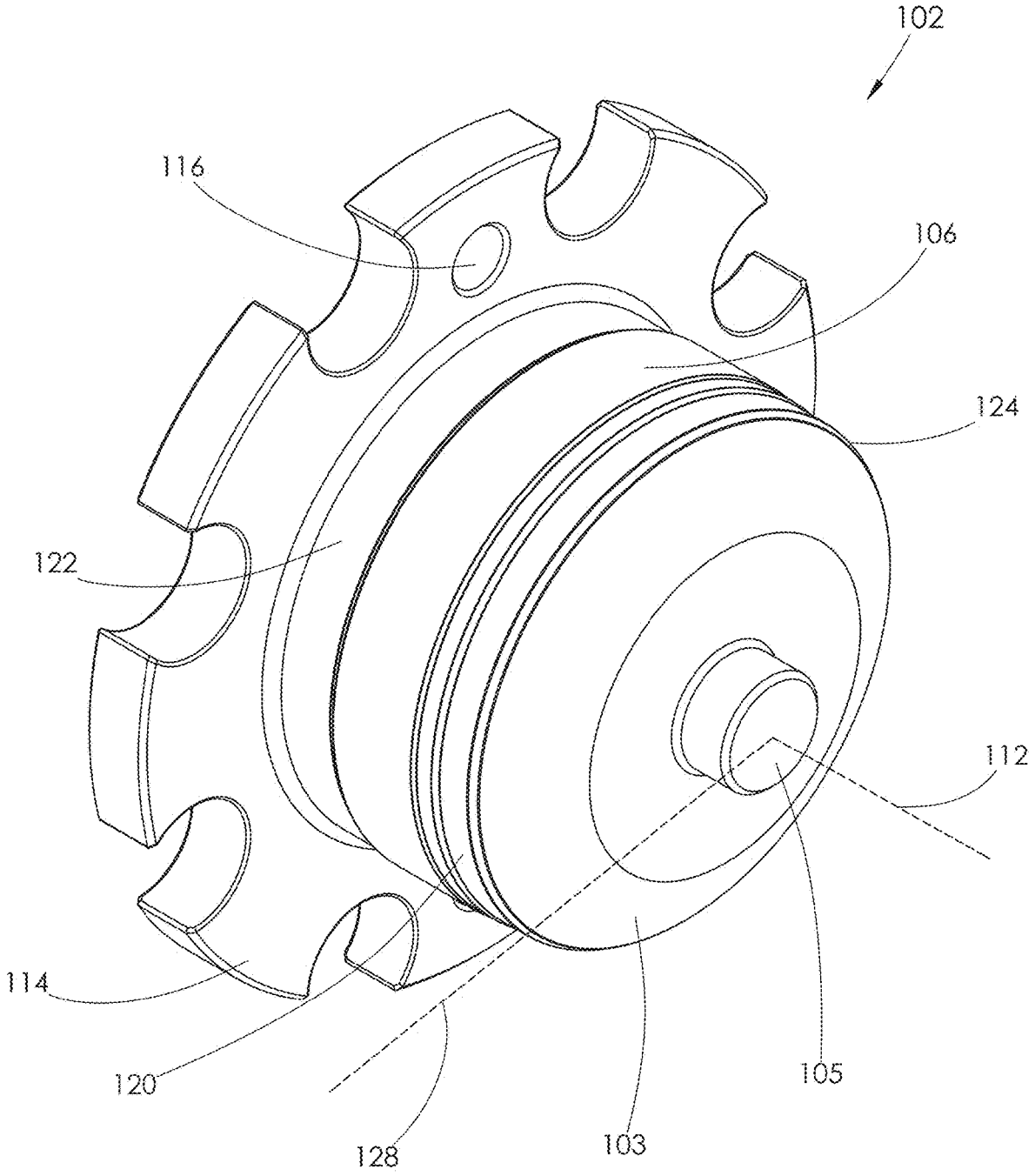
FIG. 2 is an isometric view of a discharge plug.

Since the features essential to the description of this invention are the same for both plugs 100, 102 those features will be given the same reference numbers. FIG. 1 shows the suction plug 100 while FIG. 2 shows the discharge plug 102.

The wear surface of the seal joint between the plugs and the body 104 is on the plugs 100, 102. The plugs 100, 102 can be replaced easier and with less expense than repairing the fluid end body 104.

FIG. 1 shows the suction plug 100. The suction plug 100 has a mounting flange 114 with mounting holes 116 through which bolts (not shown) are assembled to retain the suction plug 100 in its correct position in the fluid end body 104 during operation. Screws, pins, and other connectors may alternatively be utilized as connectors between the flange 114 and the fluid end body 104.

The plug 100 further comprises a body 101 with a generally circular cross-sectional profile having a center axis 112. The body 101 has a variable diameter along its length. In general, the body 101 has three sections 106, 120, 122 of constant diameter with tapered transitions therebetween. Each section of the body has a smaller diameter than the mounting flange 114.

The sealing section 106 of the suction plug 100 is the portion of the suction plug 100 body 101 with the maximum outside diameter. The diameter of the sealing section 106 should approximately match the diameter of the bore 118 in which it is situated. Further, this section 106 should be longitudinally situated next to the seal 108 in the fluid end body 104 as shown in FIG. 3.

For proper sealing, the diameter of the sealing section 106 has an interference fit with the inside diameter of the seal 108. An interference fit decreases the clearance and increases friction during assembly and disassembly. To minimize this friction, the axial length of the sealing section 106 is minimized. Preferably, the sealing section 106 has an axial length of less than half of the length of the plug.

The sections 120, 122 on either side, axially, of the sealing section 106 have reduced diameters. The section 120 of the suction plug 100 the farthest distance away from the mounting flange 114, axially, may also have a chamfered nose 124 to assist in the initial alignment of the suction plug 100 as it is inserted in the bore 118 and contacts the seal 108.

Figure 4:
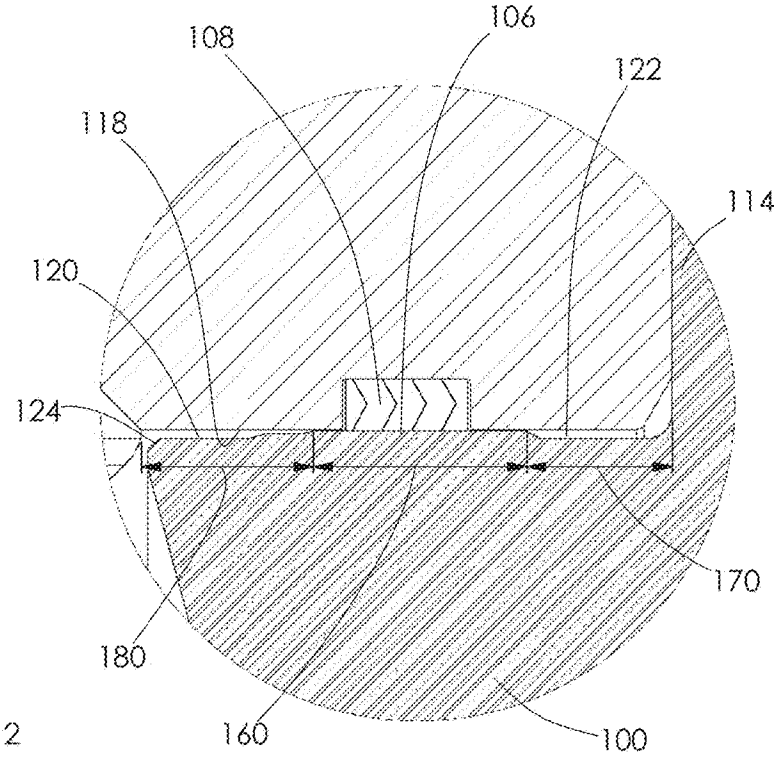
FIG. 4 is a detail view of detail 4 shown in FIG. 3.

Section 122 is situated between the sealing section 106 and the mounting flange 114. The reduced diameter of section 122 results in a small annular space created between the seal 108 and the flange 114, as best seen in FIG. 4.

The sections 106, 122, 120 correspond to a longitudinally-extending closure zone having regions 160, 170, 180. The first region 160 is spaced apart from the external surface 202 and within this region 160 the plug 100, 102 at sealing section 106 engages the walls of the bore 118, 136 and/or the seals 108. Within the second region 170, the plug 100, 102 does not engage the walls of the bore, and this region extends without interruption to the external surface. The third region 180 is disposed between the first region 160 and the internal chamber, and the walls of the plug 100, 102 do not extend to the walls of the bore 118, 136.

To assemble, the suction plug 100 is inserted in the bore 118. The bore 118 is the section of first bore 204 between the internal chamber 208 and external surface 202. As a practical matter, any of the bores of the fluid end body 104 may have similar constructions.

An axial force is applied to an outside surface 126 of the plug 100. Accordingly, the sealing sections 106 and adjacent sections 120, 122 are inserted into the bore 118 along the center axis 112. Once the suction plug 100 is inserted far enough into the bore 118 the retention bolts are inserted through the mounting holes 116 of the mounting flange 114 and tightened into threaded holes (not shown) of the fluid end body 104.

When the retention bolts are tightened to the appropriate torque the sealing section 106 of the suction plug 100 is positioned against the seal 108 installed in the fluid end body 104. The axial force required to insert the suction plug 100 to the correct position in the fluid end body 104 has been reduced from that required to insert a plug with a uniform interference fit diameter.

Another advantage of the smaller diameter of section 120 and section 122 is the diametral clearance provided. The clearance allows the suction plug 100 to be rotated about an axis 128 perpendicular to the center axis 112 of the suction plug 100. It should be understood that axis 128 in FIGS. 1 and 2 is shown for exemplary purposes and that any line transverse to the center axis 112 is a potential axis of rotation for plug 100. Rotation causes the suction plug 100 to be rocked as the insertion force is being applied. The sealing section 106 is the fulcrum for the rotation which allows the suction plug 100 to be worked into or out of the bore 118 in a stepwise manner.

The suction plug 100 may be rocked from the position where a first contact point 130 on section 122 contacts the inner diameter of the bore 118 while a second contact point 132 opposite the first contact point 130 and on section 120 contacts a point on the inside diameter of the bore 118.

To disassemble, a threaded rod (not shown) is torqued into a threaded hole 134 in the outside surface 126 of the suction plug 100. The threaded hole 134 may be coincident with the center axis 112. The threaded rod may be a component of a slide hammer or other items used for removal of plugs.

A force is applied to the threaded rod to remove the suction plug 100 from the bore 118. The force may be generally along the center axis 112. The diametral clearance provided by sections 120, 122 also allows the suction plug 100 to be rotated about a perpendicular axis 128 while the removal force is being applied along the center axis 112. This rotation allows the suction plug 100 to be worked out of the bore 118 in a step wise fashion using the sealing surface 106 as a fulcrum as described above. However, in this instance the suction plug 100 is being removed instead of inserted.

The relevant structure, assembly, and disassembly are the same for the discharge plug 102 and bore 136. As shown in FIG. 2, the discharge plug 102 has a body 103 with sections of differing diameter. The discharge plug 102 only differs in that it has a protrusion 105 to retain the spring 222 that provides the biasing force to the discharge valve 210. This structure is not necessary on the suction plug 100.

Another embodiment of this invention may remove material from the bores to provide the diametral clearances needed to allow the rotation of the plugs about the axis 128 perpendicular to the center axis 112. In this embodiment the diameter of the bores are increased before and after the seals which has a segment with an axial length of a smaller diameter to support the seals. The diameter of the plugs may be constant in this embodiment.

One skilled in the art can appreciate the possibility of using any combination of reduced outside diameter of the plugs combined with an increased diameter of the bores to allow the rotation of the plugs about the perpendicular axis or possibly both increasing the diameter of the bores and decreasing the diameter of the plugs in areas that are not the sealing surface or supporting the seal. The fulcrum, or center of rotation, would always be the sealing area of the plug and bore.

Another embodiment of this invention includes the possibility of reducing the diameter of the plugs on only one side of the sealing section. This would reduce the possible rotation about the perpendicular axis by approximately half but would still provide more opportunity for movement than no reduction at all. It is contemplated that the smaller diameter section could be either before or after the sealing section, or may be a larger diameter section in the bores either before or after the seal, or could be both increased bore diameter and decreased plug diameter. This embodiment will also work with the typical fluid end sealing set up that has the seal in the plug.

Figure 8:
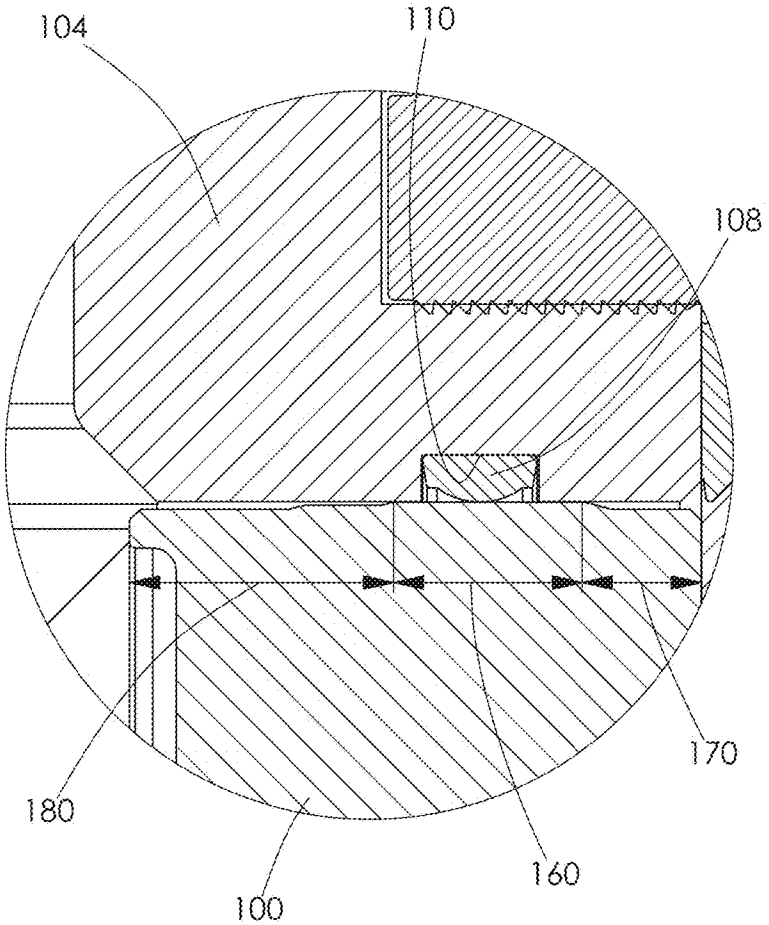
FIG. 8 is a detail view of detail 8 shown in FIG. 7.
Figure 7:
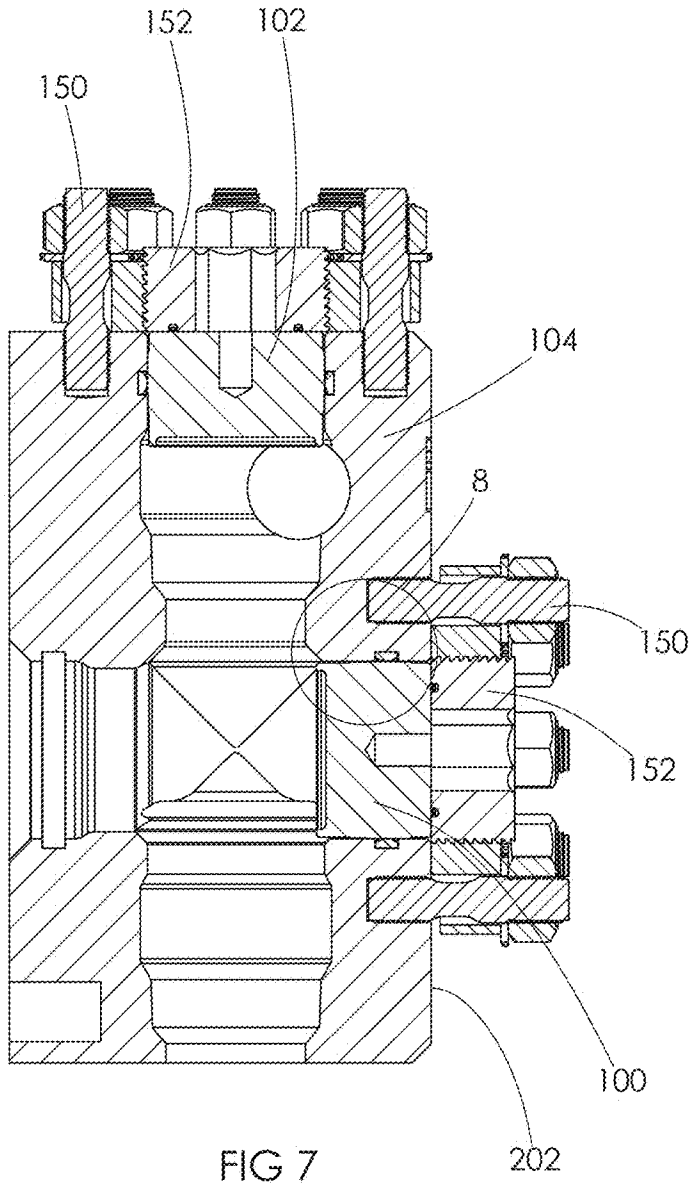
FIG. 7 is a sectional view of a fluid end having a suction and discharge plug with a flangeless construction. Hardware, such as valves, seats, springs, the plunger and stuffing box sleeves, has been removed from this figure for clarity.

As shown in FIGS. 6-8, an embodiment of this invention includes the possibility that there is no flange on the plugs 100, 102. The plugs 100, 102 may be inserted until they are flush with the fluid end body. In this embodiment a separate retainer element 150 may be used to retain the plugs in position during operation. The retainer element 150 may have an internally threaded nut 152 disposed within it. The nut 152 can be removed without removing the bolts or fasteners holding the retainer fast to the external surface 202.

The body of plugs 100, 102 are otherwise similar in construction, and have similarly formed sections 106, 120, 122. The sections correspond to a longitudinally-extending closure zone having regions 160, 170, 180. As with the embodiment shown in FIGS. 3 and 4, the first region 160 is spaced apart from the external surface 202 and the plug at sealing section 106 engages the walls of the bore. Within the second region 170, the plug 100, 102 does not engage the walls of the bore, and this region extends without interruption to the external surface. The third region 180 is disposed between the first region 160 and the internal chamber, and the walls of the plug 100, 102 do not extend to the walls of the bore.

If threaded, the diametral clearances obtained by either increasing the bore dimeters, reducing the plug diameters, or both, may only be of assistance until the threads engage, at which point the possibility of perpendicular axial rotation is eliminated; however, the increased clearance will still reduce the friction and thus the torque required to assemble and disassemble. Various modifications can be made in the design and operation of the present invention without departing from the spirit thereof. Thus, while the principle preferred construction and modes of operation of the invention have been explained in what is now considered to represent its best embodiments, which have been illustrated and described, it should be understood that the invention may be practiced otherwise than as specifically illustrated and described.

The invention claimed is:

1. A fluid end, comprising:
- a body having a bore formed therein;
- a valve pair situated within the bore;
- an annular groove formed in a wall surrounding the bore;
- a seal disposed in the annular groove; and
- a plug disposed within the bore, the plug comprising:
  - a plug body joined to a flange section, the plug body comprising:
    - a first section having a first diameter;
    - a second section having a second diameter;
    - a third section having a third diameter; and
    - a protrusion extending from the third section, the protrusion having a fourth diameter;
    - in which the seal is in contact with and surrounds the plug body at the second section;
    - in which the second section is positioned intermediate the first and third sections;
    - in which the second diameter is greater than both the first and third diameters; and
    - in which both the first and third diameters are greater than the fourth diameter.

2. The fluid end of claim 1, in which no portion of the plug body is threaded.

3. The fluid end of claim 1, in which the flange section comprises a threaded opening formed therein.

4. The fluid end of claim 1, in which the plug is a discharge plug.

5. A fluid end, comprising:
- a housing having a bore formed therein;
- a seal situated within a wall surrounding the bore;
- a first plug situated at least partially within the bore, the first plug comprising:
  - a body, comprising:
    - a first section defining a first maximum diameter;
    - a second section defining a second maximum diameter;
    - a third section defining a third maximum diameter, the third section situated within the bore; and
    - a protrusion extending from the first section, the protrusion having a fourth maximum diameter;
    - in which the fourth maximum diameter is smaller than the first, second, and third maximum diameters;
    - in which the second maximum diameter is greater than both the first and third maximum diameters;
    - in which the second section is situated intermediate the first and third sections;
    - in which the body engages the seal at only the second section; and
    - in which the first section is installed further within the bore than the second and third sections.

6. The fluid end of claim 5, in which the first plug further comprises:
- a flange joined to the body, the flange having a flange maximum diameter which is greater than the second maximum diameter.

7. The fluid end of claim 6, in which the flange is not situated within the bore.

8. The fluid end of claim 5, in which the housing has a second bore formed therein, the fluid end further comprising:
- a second plug situated within the second bore.

9. The fluid end of claim 8, in which the first plug is a discharge plug.

10. The fluid end of claim 8, in which the second plug is a suction plug.

11. The fluid end of claim 8, in which the second bore is configured to receive at least a portion of a reciprocating plunger.

12. The fluid end of claim 5, in which the first plug is secured to the housing by a plurality of fasteners.

13. The fluid end of claim 5, further comprising:
- a first annular clearance surrounding the first section of the body; and a second annular clearance surrounding the second section of the body.

14. The fluid end of claim 5, in which the protrusion is configured to retain a spring.

* * * * *